US009918574B1

(12) United States Patent
Madsen

(10) Patent No.: US 9,918,574 B1
(45) Date of Patent: Mar. 20, 2018

(54) SNACK FOOD SERVING DEVICE

(71) Applicant: Marquel Madsen, Andover, MN (US)

(72) Inventor: Marquel Madsen, Andover, MN (US)

( * ) Notice: Subject to any disclaimer, the term of this patent is extended or adjusted under 35 U.S.C. 154(b) by 0 days.

(21) Appl. No.: 15/498,868

(22) Filed: Apr. 27, 2017

Related U.S. Application Data

(60) Provisional application No. 62/329,344, filed on Apr. 29, 2016.

(51) Int. Cl.
*A47G 21/10* (2006.01)

(52) U.S. Cl.
CPC ..... *A47G 21/10* (2013.01)

(58) Field of Classification Search
CPC ..... B25B 9/02; A47G 21/10; A47J 43/283
USPC ..... 294/99.2
See application file for complete search history.

(56) References Cited

U.S. PATENT DOCUMENTS 223,066 A * 12/1879 Russelll, Jr. ..... F24B 15/10 294/11
4,964,663 A * 10/1990 Jermyn ..... A61F 9/0061 294/1.2
5,363,841 A * 11/1994 Coker ..... A61B 17/0206 600/211
5,795,002 A * 8/1998 Boron ..... B25B 9/02 294/3
D573,306 S * 7/2008 Yoo ..... D28/21
2009/0001739 A1* 1/2009 Risch ..... B29C 45/0062 294/3
2009/0322108 A1* 12/2009 Bina ..... A47G 21/10 294/99.2
2011/0221217 A1* 9/2011 Grosse ..... B25B 9/00 294/99.2

* cited by examiner

*Primary Examiner* — Stephen A Vu
(74) *Attorney, Agent, or Firm* — Michael A. Bondi; Moss & Barnett

(57) ABSTRACT

A snack food serving device that includes a handle portion, a first gripper portion and a second gripper portion. The handle portion has a first handle member and a second handle member that are operably attached to each other. The first gripper portion is attached to the first handle member. The first gripper portion includes a first plurality of gripping members radially extending therefrom. The second gripper portion is attached to the second handle member. The second gripper portion includes a second plurality of gripping members radially extending therefrom.

18 Claims, 4 Drawing Sheets

SNACK FOOD SERVING DEVICE

REFERENCE TO RELATED APPLICATION

This application claims priority to Provisional Applic. No. 62/329,344, filed on Apr. 29, 2016, the contents of which are incorporated herein by reference.

FIELD OF THE INVENTION

The invention is directed to a food serving utensil. More particularly, the invention is directed to a snack food serving device.

BACKGROUND OF THE INVENTION

Snack foods are popular to be served at gatherings such as barbecues. Snack foods include a wide range of products such as potato chips, pretzels, tortilla chips and cheese puffs. Because of the relatively high cost associated with packaging individual servings of the snack foods, it is customary to put the snack foods into a large bowl. Each person is then able to obtain a desired serving amount of a particular snack food.

While a person's hand is particularly suited for grasping a desired amount of the snack food while minimizing damage to the snack food during the serving process, sanitary concerns make it undesirable for persons to use their hands to serve the snack foods.

Another option for serving the snack foods is to use a large spoon. A drawback of this option is that many snack foods have an irregular shape that presents challenges for obtaining a reasonable amount of the snack food in the spoon even if the spoon has a relatively large size. This situation not only increases the time for each person to obtain a desired amount of the snack food but also can lead to significant frustration associated with serving the snack food.

SUMMARY OF THE INVENTION

An embodiment of the invention is directed to a snack food serving device that includes a handle portion, a first gripper portion and a second gripper portion. The handle portion has a first handle member and a second handle member that are operably attached to each other. The first gripper portion is attached to the first handle member. The first gripper portion includes a first plurality of gripping members radially extending therefrom. The second gripper portion is attached to the second handle member. The second gripper portion includes a second plurality of gripping members radially extending therefrom.

Another embodiment of the invention is directed to a snack food serving device that includes a handle portion, a first gripper portion and a second gripper portion. The handle portion includes a first handle member and a second handle member. The first handle member has an elongated shape with a first proximal end and a first distal end. The second handle member has an elongated shape with a second proximal end and a second distal end. The first handle member and the second handle member are pivotally attached to each other proximate the first distal end and the second distal end. The first distal end is biased away from the second distal end. The first gripper portion is attached to the first distal end. The first gripper portion has a first plurality of gripping members radially extending therefrom. The second gripper portion is attached to the second distal end. The second gripper portion includes a second plurality of gripping members radially extending therefrom. At least a portion of the gripping members in the first plurality of gripping members and the second plurality of gripping members are flexible.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
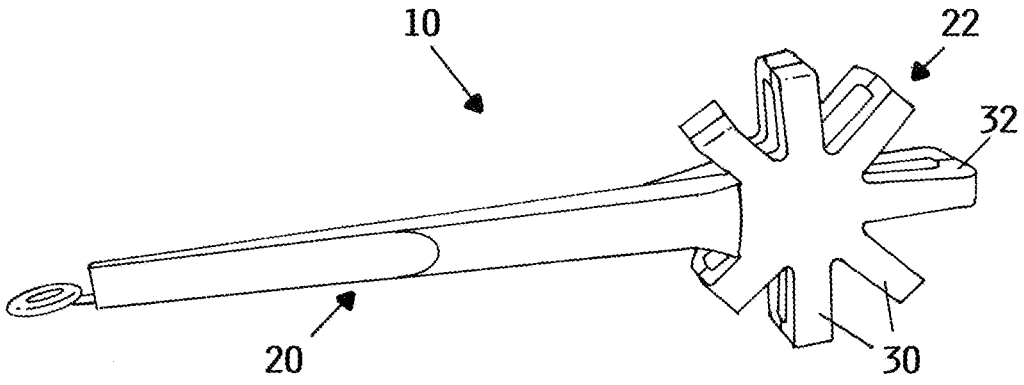
FIG. 1 is a side view of a snack food serving device according to an embodiment of the invention where the snack food serving device is in a closed configuration.
Figure 2:
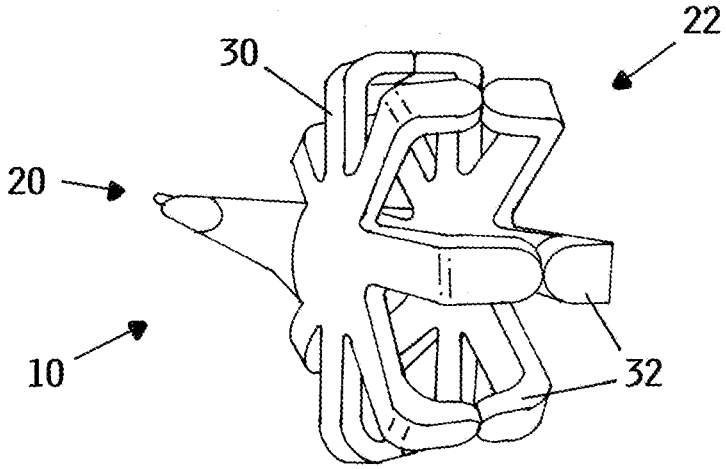
FIG. 2 is an end view of the snack food serving device in the closed configuration.
Figure 3:
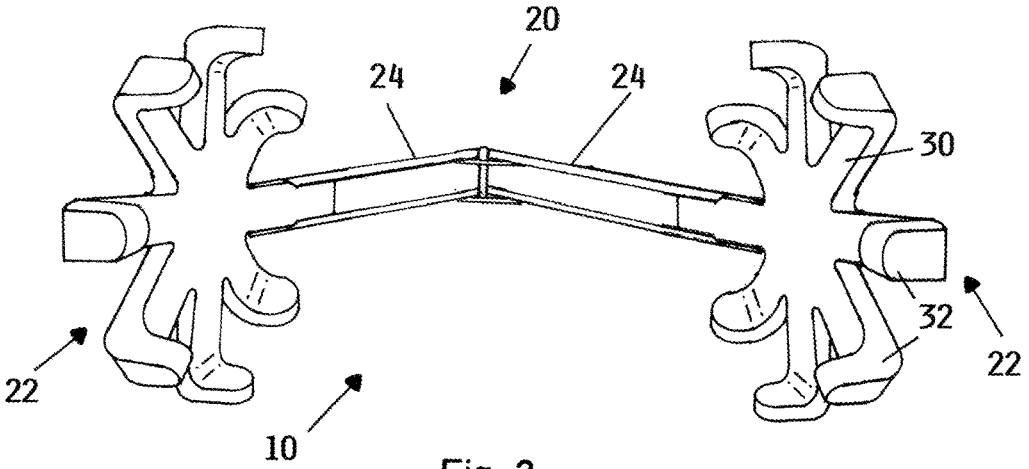
FIG. 3 is an end view of the snack food serving device in an open configuration.
Figure 4:
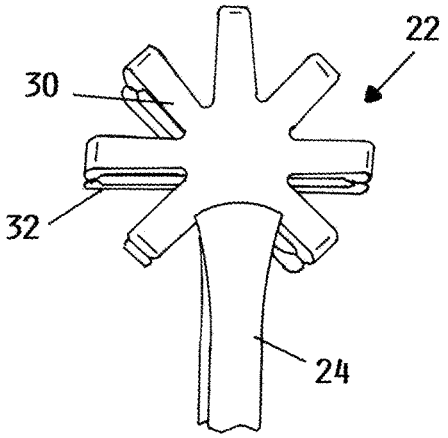
FIG. 4 is a top view of a gripper portion of the snack food serving device.
Figure 5:
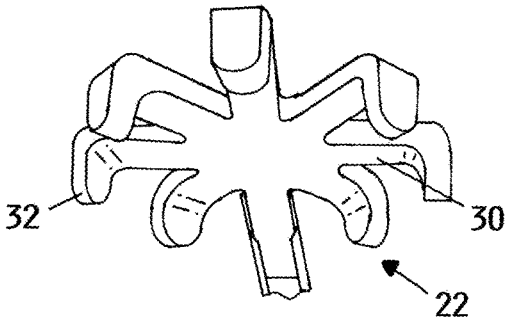
FIG. 5 is a bottom perspective view of the gripper portion.

An embodiment of the invention is directed to a snack food gripping device, as illustrated at 10 in the figures. The snack food gripping device 10 is particularly suited for serving fragile snack foods while minimizing breakage of the snack foods. The snack food gripping device 10 also provides portion control such that a desired amount of the snack food is grasped each time the snack food gripping device 10 is used.

The snack food gripping device 10 generally includes a handle portion 20 and a gripper portion 22. The handle portion 20 includes two elongated handle members 24 that are operably attached to each other. In certain embodiments, the elongated handle members 24 are pivotally attached to each other. In certain embodiments, the elongated handle members 24 may have a length of between about 3 inches and about 24 inches.

The elongated handle members 24 may be biased away from each other such as using a spring (not shown). Using such a configuration causes the handle portion 20 to be in an open configuration when the snack food gripping device 10 is placed into a bowl from which it is desired to obtain the snack food.

The gripper portion 22 is attached the distal ends of each of the elongated handle members 24. While it is illustrated that the gripper portion 22 is fabricated from a material that is different than the material that is used to fabricate the elongated handle members 24, it is possible for the gripper portion 22 to be integrally fabricated with the elongated handle member 24.

The gripper portion 22 has a plurality of gripping members 30 radially extending therefrom. The gripping members are arranged in a spaced-apart configuration. In certain embodiments, the spacing between each of the gripping members 30 is approximately equal. The orientation of the gripping members 30 defines an opening between each of the adjacent gripping members 30.

The number, length, width, spacing and tip angle each play a role in the snack food gripping device 10 being able to grasp the snack food while minimizing breakage of the snack food during the dispensing process. Another advantage is that the preceding features reduce the potential of small snack food pieces being grasped therein as such small snack food pieces are often less desirable to consumers than the full-size, unbroken chips.

In certain embodiments, there are between 4 and 10 gripping members 30 on each gripper portion 22. In other embodiments, there are 7 gripping members 30 on each gripper portion 22. In this configuration, an angle between adjacent gripping members 30 is about 45 degrees. This number of gripping members 30 facilitates grasping the snack food while at the same time having openings therebetween in which the snack food can extend during the gripping process.

When the snack food gripping device 10 is used in conjunction with conventional size potato chips or tortilla chips, each of the gripping members 30 may have a length of between about 1 inch and about 3 inches. In other embodiments, the gripping members 30 may have lengths of between about 1.00 inches and about 1.75 inches. The length may be increased for use with larger snack food pieces or decreased for use with smaller snack food pieces.

The lengths of the gripping members 30 may be symmetrical on the right and left sides of the gripper portion 22. The gripping members 30 proximate a proximal end of the gripper portion 22 may have a length that is less than the length of the gripping member 30 proximate the distal end of the gripper portion 22.

Figure 6:
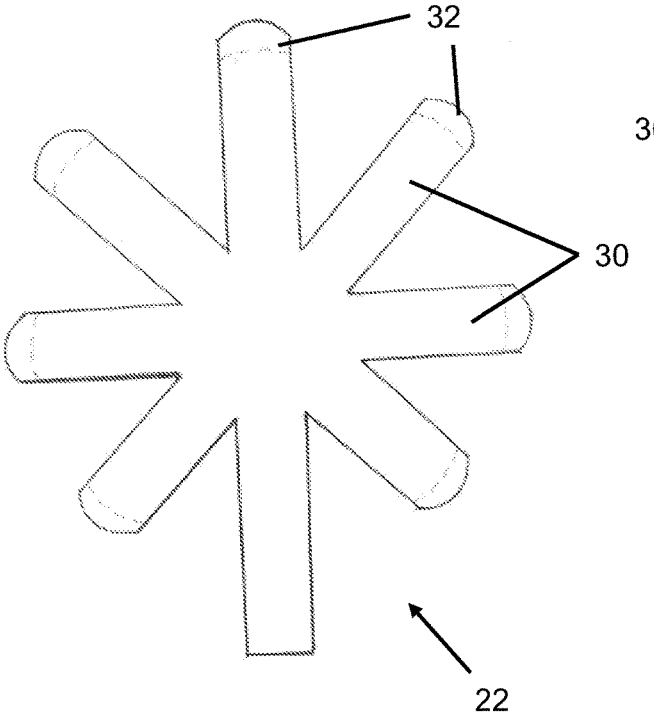
FIG. 6 is a top view of the gripper portion.

Using conventional map directions with the orientation of the gripper portion 22 set forth in FIG. 6, the north gripping member has a length of about 1.75 inches. The northeast and northwest gripping members each have a length of about 1.5 inches. The east and west gripping members each have a length of about 1.25 inches. The southeast and southwest gripping members each have a length of about 1.25 inches. Using such a configuration, the gripping members 30 located closer to the handle portion 20 have a length that is at least about 25 percent shorter than the gripping members 30 located further from the handle portion 20.

The gripping members 30 may have a width that is substantially consistent between the proximal and distal ends thereof with the exception of a distal tip 32, which may be tapered as discussed in more detail below. In certain embodiments, the width of the gripping members 30 is between about 0.50 inches and about 0.75 inches. In other embodiments, the width of the gripping members 30 is about 0.675 inches.

The gripping members 30 may have a thickness that is substantially consistent between the proximal and distal ends thereof with the exception of the distal tip 32, which may be tapered as discussed in more detail below. In certain embodiments, the thickness of the gripping members is about 0.25 inches.

The gripping members 30 may each have a generally planar shape extending between the proximal and distal ends thereof with the exception of the distal tip 32, which is curved as discussed in more detail below.

The distal tips 32 are inwardly curved to enhance the ability of the gripper portion 22 to grasp the snack food and retain the snack food between the adjacent gripper portions 22 when the snack food gripping device 10 is in the closed configuration, as illustrated in FIG. 1.

The angle of curvature of the distal tips 32 may be between about 60 degrees and about 100 degrees. In other embodiments, the angle of curvature of the distal tips 32 is between about 90 and 100 degrees.

Similar to the differences in the lengths of the gripping members 30 that is discussed above, the distal tips 32 may have different angles. Using the same conventional map direction that are discussed above, the distal tip 32 on the north gripping members may be oriented at an angle of about 90 degrees. The distal tips 32 on the other gripping members may be oriented at an angle of about 95 degrees.

Figure 7:
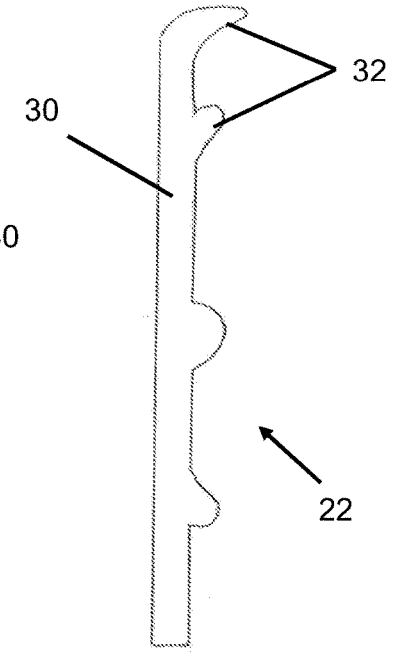
FIG. 7 is a side view of the gripper portion.
Figure 8:
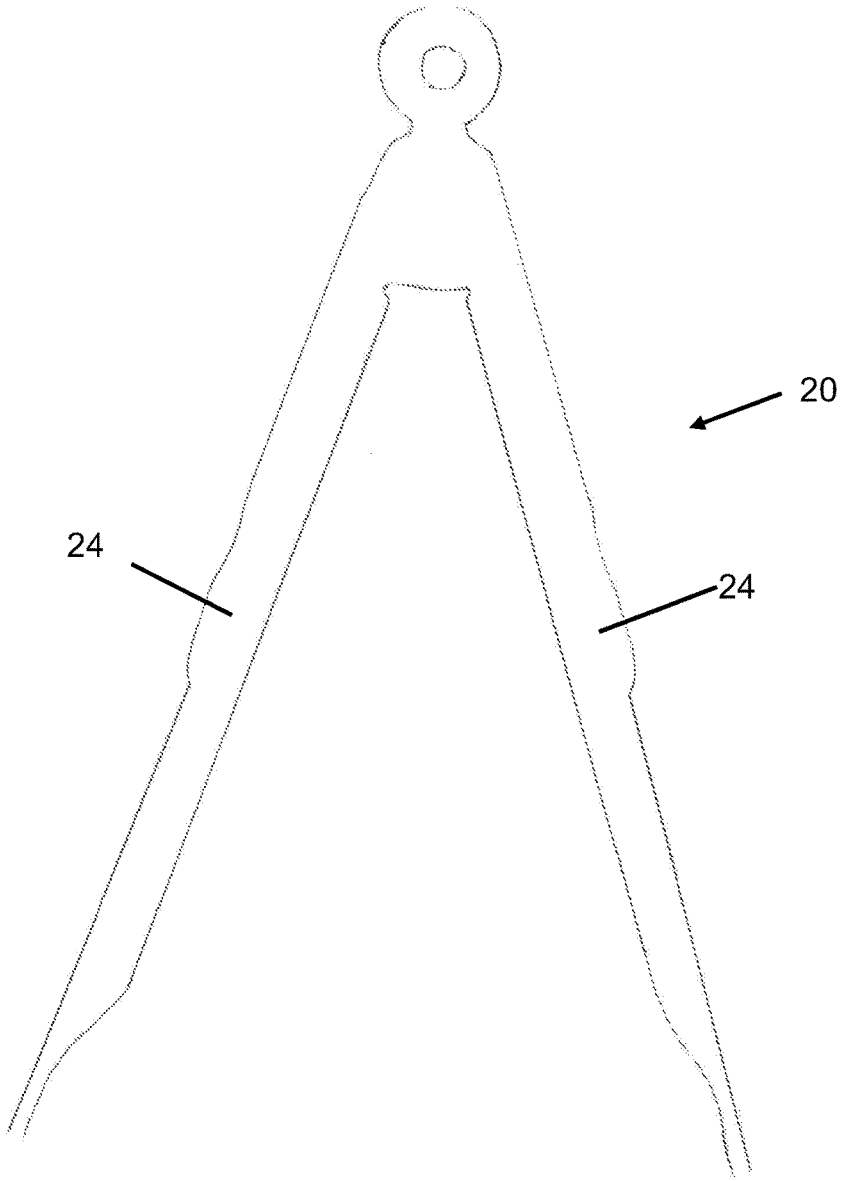
FIG. 8 is a side view of the handle portion of the snack food gripping device.

The distal tips 32 on each of the gripping members 30 may have a similar length. Because of the different angular orientations of the distal tips 32, the distal tip on the north gripping member extends further away from the other portion of the gripping members 30 as illustrated in FIG. 7.

The north oriented gripping member is generally aligned along an axis of the handle portion 20 from which the gripping member is associated. The distal tip of the north oriented gripping member extends further from the gripper portion 22 than other gripping members that extend from the gripper portion 22.

The ends of the distal tips 32 may be curved as illustrated in the drawings. Such curvature not only reduces the potential of contact between the distal tips and the snack food causing damage to the snack food but also reduces the potential of a user being injured caused by contact with the end of the distal tips.

The gripper portions 22 may be attached to the distal end of the elongated handle member 24 using a variety of techniques. The attachment technique should facilitate quick attachment of the gripper portion 22 to the elongated handle member 24 while also resisting separation of the gripper portion 22 from the elongated handle member 24. An example of one suitable technique is friction fit.

At least a portion of the gripping members 30 may be fabricated from a resilient material that has the ability to flex in response to a force place thereupon. In certain embodiments, a portion of the gripping members 30 that is proximate the distal tip 32 has a greater amount of flexibility than proximate a central region of the gripping members 30. An example of one such material that facilitates flexing of the gripping members 30 is silicon.

The flexing of the gripping members 30 reduces the potential of fragile items such as potato chips being broken when grasped with the snack food gripping device 10. However, the resilient material is not too flexible so that the gripping members 30 exhibit sufficient rigidity to enable objects to be grasped in the snack food gripping device.

In certain embodiments, at least a portion of the gripping members 30 are fabricated from a material that enables the gripping members 30 to be bent into a desired shape and that remain in the shape to which the gripping members 30 are bent. In one such configuration, these features may be provided by fabricating at least a portion of the gripping members 30 from a metallic material. The metallic material may be at least partially covered with a polymeric or plastic material.

At least part of an inner surface of the gripping members 30 may be fabricated from or coated from a friction enhancing material to minimize the potential of objects being grasped with the snack food gripping device 10 moving when held in the snack good gripping device 10. This configuration reduces the force at which the handle portions 20 need to be urged towards each other, which reduces the potential of fragile items such as potato chips being broken when grasped with the snack food gripping device 10.

The friction enhancing material may assume a variety of configurations using the concepts of the invention. In one such embodiment, the friction enhancing material includes a plurality of raised bumps that extend from the surface of the gripping members 30. The raised bumps may have a variety of shapes such as round. The friction enhancing material may also have a roughness or a stickiness.

The snack food gripping device 10 having the preceding dimensions allows a portion to be grasped therein that is approximately equal to the amount of snack food that could be grasped in a conventional hand. Through the use of the snack food gripping device 10 it is possible to dispense approximately equal servings to each person while minimizing breakage of the snack food.

The snack food gripping device 10 thereby avoids the waste because it minimizes the generation of small chip pieces that are undesirable to many persons, which causes such small chip pieces to be discarded. The snack food gripping device 10 avoids the unsanitary nature of a person using his/her hand to dispense the snack food.

Yet another advantage of the snack food gripping device 10 described herein is that the construction minimizes the potential of snack foods becoming stuck therein. In many embodiments, it is possible to wash the snack food gripping device 10 using a conventional dishwasher.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A snack food serving device comprising:

a handle portion comprising a first handle member and a second handle member that are operably attached to each other;

a first gripper portion attached to the first handle member, wherein the first gripper portion comprises a first plurality of gripping members radially extending therefrom; and a second gripper portion attached to the second handle member, wherein the second gripper portion comprises a second plurality of gripping members radially extending therefrom, wherein the first plurality of gripping members and the second plurality of gripping members each comprise a first gripping member and a second gripping member, wherein the first gripping member is closer to the handle portion than the second gripping member and wherein the first gripping member has a length that is less than the second gripping member.

2. The snack food serving device of claim 1, wherein the first handle member and the second handle member each have an elongated shape and wherein the first handle member and the second handle member are pivotally attached to each other.

3. The snack food serving device of claim 2, wherein the first handle member is biased away from the second handle member.

4. The snack food serving device of claim 1, wherein the first handle member and the second handle member both have a proximal end and a distal end, wherein the first handle member and the second handle portion are operably attached to each other proximate the proximal ends thereof, wherein the first gripping member is attached to the distal end of the first member portion and wherein the second gripping member is attached to the distal end of the second handle member.

5. The snack food serving device of claim 1, wherein the first plurality of gripping members and the second plurality of gripping members each comprise 7 gripping members and wherein a spacing between adjacent the gripping members is substantially equal.

6. The snack food serving device of claim 1, wherein at least a portion of the gripping members in the first plurality of gripping members and the second plurality of gripping members are flexible.

7. The snack food serving device of claim 1, wherein the gripping members in the first plurality of gripping members and the second plurality of gripping members are more flexible proximate a distal end thereof than proximate a proximal end thereof.

8. The snack food serving device of claim 1, wherein a width of the gripping members in the first plurality of gripping members and the second plurality of gripping members is substantially consistent over a length of the gripping members in the first plurality of gripping members and the second plurality of gripping members.

9. The snack food serving device of claim 1, wherein the gripping members in the first plurality of gripping members and the second plurality of gripping members each have a generally planar shape with a distal tip extending from a distal end thereof and wherein the distal tip is curved with respect to each of the gripping members in the first plurality of gripping members and the second plurality of gripping members from which the distal tip extends.

10. The snack food serving device of claim 9, wherein the distal tip is oriented at an angle with respect to each of the gripping members in the first plurality of gripping members and the second plurality of gripping members of between about 60 degrees and about 90 degrees.

11. The snack food serving device of claim 9, wherein the second gripping member is generally aligned along an axis of the handle member from which the second gripping member is attached and wherein the distal tip of the second gripping member is longer than the distal tip of the first gripping member.

12. The snack food serving device of claim 1, wherein the first and second gripper portions are removably attached to the handle portion.

13. The snack food serving device of claim 1, wherein at least a portion of the gripping members are fabricated from a bendable material.

14. A snack food serving device comprising:

a handle portion comprising:

a first handle member having an elongated shape with a first proximal end and a first distal end; and a second handle member having an elongated shape with a second proximal end and a second distal end, wherein the first handle member and the second handle member are pivotally attached to each other proximate the first distal end and the second distal end and wherein the first distal end is biased away from the second distal end;

a first gripper portion attached to the first distal end, wherein the first gripper portion comprises a first plurality of gripping members radially extending therefrom; and a second gripper portion attached to the second distal end, wherein the second gripper portion comprises a second plurality of gripping members radially extending therefrom and wherein at least a portion of the gripping members in the first plurality of gripping members and the second plurality of gripping members are flexible, wherein the gripping members in the first plurality of gripping members and the second plurality of gripping members each have a generally planar shape with a distal tip extending from a distal end thereof and wherein the distal tip is oriented at an angle with respect to each of the gripping members in the first plurality of gripping members and the second plurality of gripping members of between about 60 degrees and about 90 degrees.

15. The snack food serving device of claim 14, wherein the first plurality of gripping members and the second plurality of gripping members each comprise 7 gripping members and wherein a spacing between adjacent the gripping members is substantially equal.

16. The snack food serving device of claim 14, wherein the gripping members in the first plurality of gripping members and the second plurality of gripping members are more flexible proximate a distal end thereof than proximate a proximal end thereof.

17. The snack food serving device of claim 14, wherein the first plurality of gripping members and the second plurality of gripping members each comprise a first gripping member and a second gripping member, wherein the first gripping member is closer to the handle portion than the second gripping member and wherein the first gripping member has a length that is less than the second gripping member.

18. The snack food serving device of claim 14, wherein the distal tip is curved with respect to the gripping member from which the distal tip extends, wherein the first plurality of gripping members and the second plurality of gripping members each comprise a first gripping member and a second gripping member, wherein the second gripping member is generally aligned along an axis of the handle member from which the second gripping member is associated, wherein the distal tip of the second gripping member is longer than the distal tip of the first gripping member.

* * * * *